United States Patent [19]

Fujiyama

[11] Patent Number: 4,711,486

[45] Date of Patent: Dec. 8, 1987

[54] BARBER AND BEAUTY PARLOR CHAIR

[75] Inventor: Kunio Fujiyama, New York, N.Y.

[73] Assignee: Takara Company, Somerset, N.J.

[21] Appl. No.: 939,223

[22] Filed: Dec. 8, 1986

Related U.S. Application Data

[63] Continuation of Ser. No. 755,962, Jul. 17, 1985, abandoned, which is a continuation of Ser. No. 443,564, Nov. 27, 1982, abandoned.

[51] Int. Cl.[4] ..... A47C 1/02

[52] U.S. Cl. ..... 297/71; 297/330; 297/347

[58] Field of Search ..... 297/330, 71, 84, 347; 248/421

[56] References Cited

U.S. PATENT DOCUMENTS

| | | | |
|---|---|---|---|
| 521,256 | 6/1894 | Browne | 248/421 X |
| 634,084 | 10/1899 | Gould | 297/347 X |
| 3,142,509 | 7/1964 | Ehrke et al. | 297/71 X |
| 3,495,869 | 2/1970 | Ingemansson | 297/71 |
| 3,578,379 | 5/1971 | Taylor et al. | 297/330 X |
| 3,984,146 | 10/1976 | Krestel et al. | 297/330 |
| 4,083,600 | 4/1978 | Hirth | 297/71 |
| 4,285,541 | 8/1981 | Onishi | 297/84 |

*Primary Examiner*—Francis K. Zugel
*Attorney, Agent, or Firm*—Stephen E. Feldman

[57] ABSTRACT

A barber shop or beauty parlor chair for back shampooing, i.e. the shampooing of the hair and scalp of the head of a person seated in the chair, from the rear of the person, by tilting the chair into a reclined and substantially horizontal position, so that the person or customer's neck may be readily fitted onto the shampoo bowl. The present chair features pivoted frame members manipulatable by an integral hydraulic cylinder, so that the chair is adjustable from an upright position into a reclined and substantially horizontal position, whereby back-shampooing of the head of a person sitting in the chair may readily be accomplished. The chair features pivoted frame members which are pivoted by activation of the upper plunger of a hydraulic cylinder. A foot rest plate is pivotably raised, a seat plate is raised, and a back plate is reclined, the chair being thereby adjusted from an upright position into a reclined and generally horizontal position, so that back-shampooing of the head of a person sitting in the chair may be readily accomplished.

2 Claims, 3 Drawing Figures

BARBER AND BEAUTY PARLOR CHAIR

This application is a continuation of application Ser. No. 755,962, filed July 17, 1985, now abandoned, which is a continuation of application Ser. No. 443,564, filed Nov. 27, 1982, now abandoned.

BACKGROUND OF THE INVENTION

1. Field of the Invention

A beauty parlor or barber shop chair, for back shampooing of the hair of the head of a person seated in the chair from the rear of the person may be readily accomplished.

2. Description of the Prior Art

The present chair was developed and invented for the purpose of "back-shampooing", in which the seat is raised, the back is reclined, and the chair is adjusted from an upright position into a reclined and generally horizontal position, in order to fit the person's or customer's neck onto the shampoo bowl, so that back-shampooing of the hair of the head of the person may be readily accomplished.

The original purpose of back-shampooing was to keep customers (persons being shampooed) free from bending uncomfortably forward for shampooing. The conventional chairs, however, with the back of the chair directly attached to the seat, required the beautician to support the chair back with his or her hand, when the back reclined. Furthermore, when reclined, the chair often pulled in the customer's shirt, and made him or her very uncomfortable. In addition, the complex and complicated mechanisms of prior art chairs resulted in high maintenance cost and a reduced service life.

SUMMARY OF THE INVENTION

1. Purposes of the Invention

It is an object of the present invention to provide an improved beauty parlow or barber shop chair.

Another object is to provide such a chair to facilitate the ready and easy accomplishment of the back-shampooing of the hair (and also the scalp) of the head of a person seated in the chair, from the rear of the person.

An additional object is to provide such a chair which has pivoted frame members which may be manipulated by an integral hydraulic cylinder, so that the chair is readily adjustable, from an upright position into a reclined and generally horizontal position.

A further object is to provide such a chair in which, when the pivoted frame members are pivoted, by activation of the upper plunger of a hydraulic cylinder, and the chair is rotated by 180 degrees, a foot rest plate is pivotally raised, a seat plate is raised, and a back plate is reclined, so that the chair is thereby adjusted from an upright position into a reclined and generally horizontal position, whereby back-shampooing of the hair and scalp of the head of a person sitting in the chair may be readily accomplished.

Still another object is to provide such a chair in which the person's or customer's neck is readily fitted onto the shampoo bowl, and in which the customers do not have to bend uncomfortably forward for shampooing but instead are treated by back shampooing.

Still a further object is to provide such a chair in which it is not required for the beautician to support the back with his or her hand, when the back reclined, and in which the reclined chair does not pull in the customer's shirt, or make him or her very uncomfortable.

Another purpose of this invention is to comfortably and softly fit the customer's neck into the shampoo-bowl, by creating a chair whose foot rest rises as the back reclines.

It is another goal of this invention to provide a mechanically simple chair, which keeps the maintenance cost low, the chair thus being one which will last for a long time, without breakdown or wearing out.

Still an additional object is to provide such a chair which aims at the comfort of customers, through both the upward and forward motions of the chair and the seat, that prevents the customer's shirt from being pulled, and promotes the comfortable fitting of his or her neck onto the shampoo bowl.

An object is to provide such a chair which makes shampooing more comfortable via a chair which is easier to use.

Yet another object is to provide such a chair in which, by an easy pedal which control, tall as well as short customers can arrive at the shampooing position.

Yet a further object is to provide such a chair in which a comfortable movement of the chair is created, by the smooth movement of the height control and recline control, due to the linkage mechanism which moves like a human body.

Yet an additional object is to provide such a chair which eliminates the complex operation of conventional chairs.

These and other objects and advantages of the present invention will become evident from the description which follows.

2. Brief Description of the Invention

The concept which resulted in the development and evolution of the present chair invention had, for its objective, to make shampooing more comfortable and efficient in a chair that is easier to use. By an easy pedal switch control, tall as well as short customers can arrive at the shampooing position. The nub of the invention is the pivoted linkage mechanism, which moves like a human body. The smooth movement of the height control and recline control creates a comfortable movement. The present chair also has eliminated the complex operation of conventional chairs. For the customers as well as for the beauticians, the present chair is a most ideal achievement. The present invention aims at the comfort of customers through both the upward and forward motions of the chair, and the seat, that prevents the customer's shirt from being pulled, and promotes the comfortable fitting of his or her neck onto the shampoo bowl. Furthermore, the simple mechanism of the chair keeps the maintenance cost low, and helps the chair to last for a long time without mechanical difficulties or breakdown, and without wearing out in service for a long time.

The present invention basically entails a barber shop or beauty parlor chair for back shampooing, i.e. the shampooing of the hair and scalp of the head of a person seated in the chair, from the rear of the person, by tilting the chair into a reclined and substantially horizontal position, so that the person or customer's neck may be readily fitted onto the shampoo bowl. The present chair features pivoted frame members manipulatable by an integral hydraulic cylinder, so that the chair is adjustable from an upright position into a reclined and substantially horizontal position, whereby back-shampooing of the head of a person sitting in the chair may readily be accomplished. The chair features pivoted frame members which are pivoted by activation of the upper plunger of a hydraulic cylinder. A foot rest plate is pivotably raised, a seat plate is raised, and a back plate is reclined, the chair being thereby adjusted from an upright position into a reclined and generally horizontal position, so that back-shampooing of the head of a person sitting in the chair may be readily accomplished.

The present invention thus is characterized by the provision of a beauty parlor or barber shop for back shampooing of the hair or scalp of the head of a person sitting in the chair, said chair having pivoted frame members manipulatable by an integral hydraulic cylinder, so that the chair is adjustable from an upright position into a reclined and substantially horizontal position, which comprises a barber or beauty parlor chair characterized by the provision of a main link arm which is operated through said hydraulic cylinder, a seat plate which is movable through the motion of said main link arm, a movable back plate, a curved connecting arm which is connected to a sub link, and which is attached to a connecting bracket, paid curved connecting arm being also connected to a rising bracket, and a movable footrest pivotably connected to said seat plate.

In a preferred embodiment, the present invention is directed to, and generally entails, a beauty parlor or barber shop chair having pivoted frame members manipulatable by an integral hydraulic cylinder, so that the chair is adjustable from an upright position into a reclined and generally horizontal position, whereby back-shampooing of the head of a person (customer) sitting in the chair may be readily accomplished. In this preferred embodiment, the chair generally entails and includes the combination of a generally horizontal base member, a substantially vertical supporting plate mounted to and extending upwards from the base nember, a hydraulic cylinder having an upper plunger and being pivotally mounted to the middle region of the supporting plate, a main link arm, one end of the main link arm being pivotally mounted to the upper end of the supporting plate, a middle region of the main link arm being pivotally mounted to the outer upper end of the plunger, a rising bracket pivotally linked to the other end of the main link arm, an elbow-shaped sub link, one end of the sub link being pivotally mounted to the supporting plate, the apex of the sub link being pivotally mounted to the rising bracket, a foot rest plate juxtaposed with the supporting plate, a transverse connecting arm which extends between a pivoted mounting at one end to the foot rest plate, and a pivoted mounting at the other end to the other rend of the sub link, a seat plate adapted to receive the weight of the torso of the person and being disposed adjacent and above the transverse connecting arm, one end of the seat plate being pivotally mounted to the upper end of the foot rest plate, the other end of the seat plate being mounted to the rising bracket, a curved connecting arm, one end of the curved connecting arm being pivotally mounted to both the other end of the sub link and the other end of the transverse connecting arm at a unitary pivoted linkage, a back plate adapted to receive and support the back region of the person, a connecting bracket which extends laterally from the lower end of the back plate, the other end of the curved connecting arm being pivotally attached to the connecting bracket, and an arm rest plate which extends from a middle pivoted attachment to the connecting bracket, the other end of the arm plate being attached to the rest plate. Thus, when the pivoted frame members are pivoted by activation of the upper plunger of the hydraulic cylinder, the foot rest plate is pivotally raised, seat plate is raised, and the back plate is reclined, the chair being thereby adjusted from an upright position into a reclined and substantially horizontal position, whereby back-shampooing of the head of a person sitting in the chair may be accomplished.

The invention accordingly consists in the features of construction, combination of elements, and arrangement of parts, which will be exemplified in the device and article of manufacture hereinafter described, and of which the scope of application is as elucidated supra and as will be indicated in the appended claims.

BRIEF DESCRIPTION OF THE DRAWINGS

In the accompanying drawings in which is shown one of the various possible embodiments of the invention, the disposition of the pivoted frame members for various positions of the chair is shown, as follows.

DETAILED DESCRIPTION OF THE PREFERRED EMBODIMENTS

Figure 1:
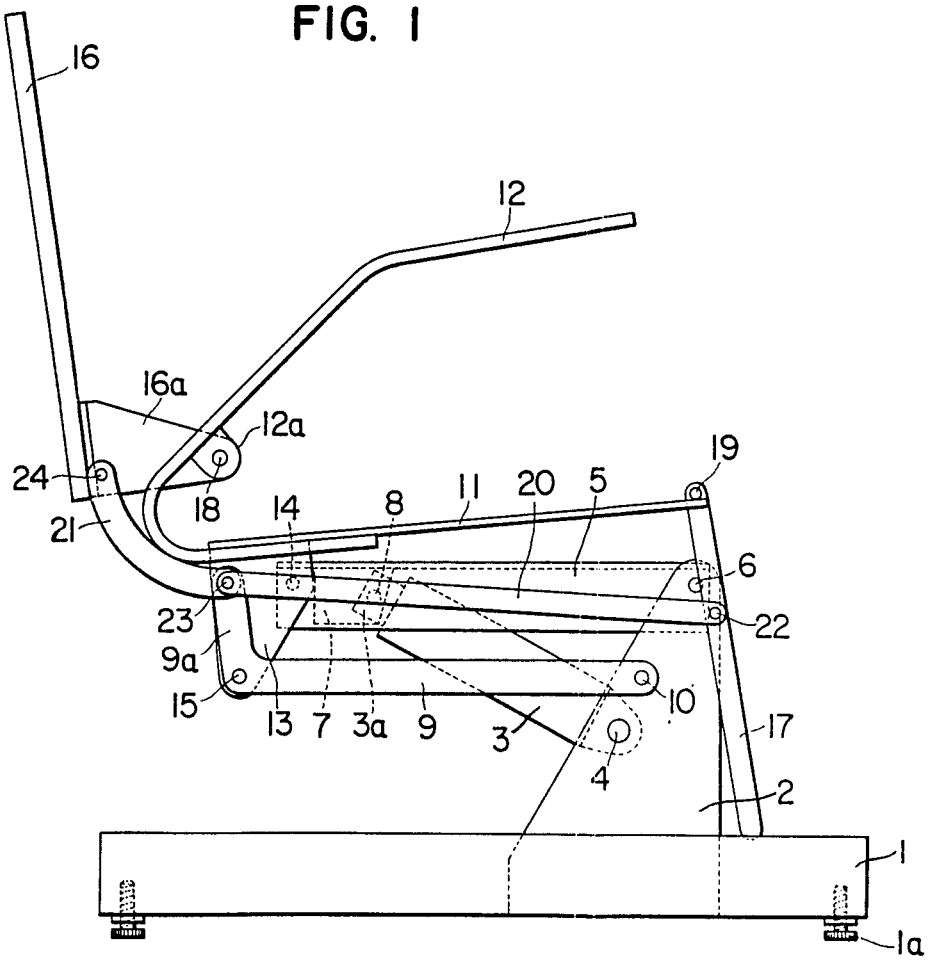
FIG. 1—Upright position.

Referring now to the drawings, the various elements of the chair structure and apparatus are as follows:

#1—Base; **#1*a*—Adjuster; #2—Supporting plate; #3—Hydraulic cylinder; #3*a*—Plunger; #4—Pivot; #5—Main link arm; #6—Pivot; #7—A section of Main Link; #8—Pivot; #9—Sub Link; #9*a*—Plate (rising); #10—Pivot; #11—Seat Plate; #12—Arm rest plate; #13—Bracket (rising); #14—Pivot; #15—Pivot; #16—Back plate; #16*a*—bracket (connecting); #17—Foot rest; #18—Pivot; #19—Pivot; #20—transverse connecting arm; #21—curved connecting arm; #22—Pivot; and #23**—Pivot.

To summarize the operation of the structure of the present chair,

#1 is the base; **#1*a* is the adjuster, #2 is the supporting plate; #3 is the hydraulic cylinder; #3*a* is the plunger; #5 is the main link; #7 is a section of the main link #5 attached to the plunger #3*a* by the pivot #8**.

#9 is the sub-link attached to #2 by the pivot #10. #11 is the seat plate which supports the armrest plate #12. #13 is the bracket. The bracket #13 is attached to the main link #5 by the pivot #14. Also at the end of the sub-link #9, the plate **#9*a* is attached and #9*a* is attached to the bracket #13 by the pivot #15**.

#16 is the back plate; #17 is the foot rest. End section of **#16*a* is attached to #12*a* by a pivot, #18**.

#20 is the transverse connecting arm and #21 is the curved connecting arm. #20 is attached to the foot rest by the pivot #22. #21, 20 and 9 are all connected by a pivot #23. #21 is connected to **#16*a* by a pivot #24**.

Figure 2:
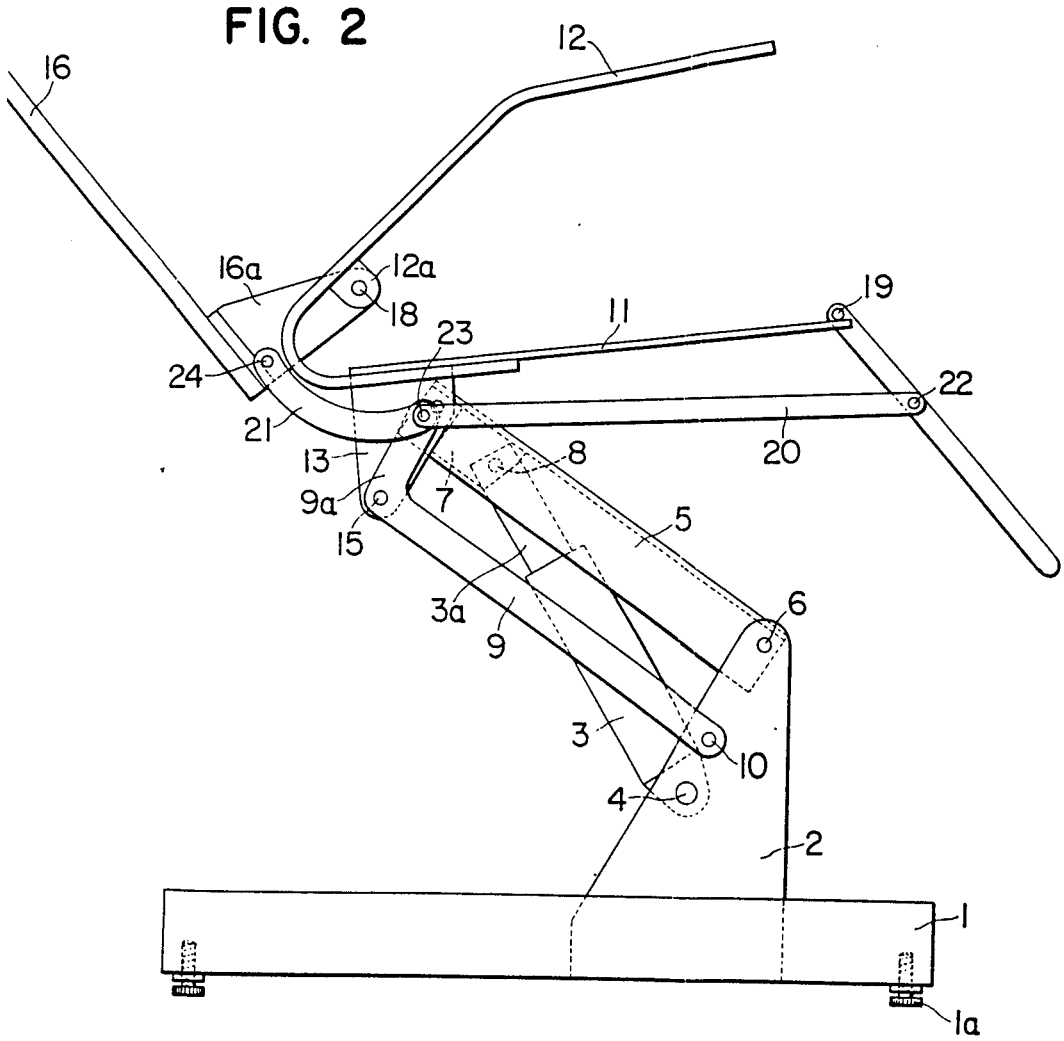
FIG. 2—Partially reclined.
Figure 3:
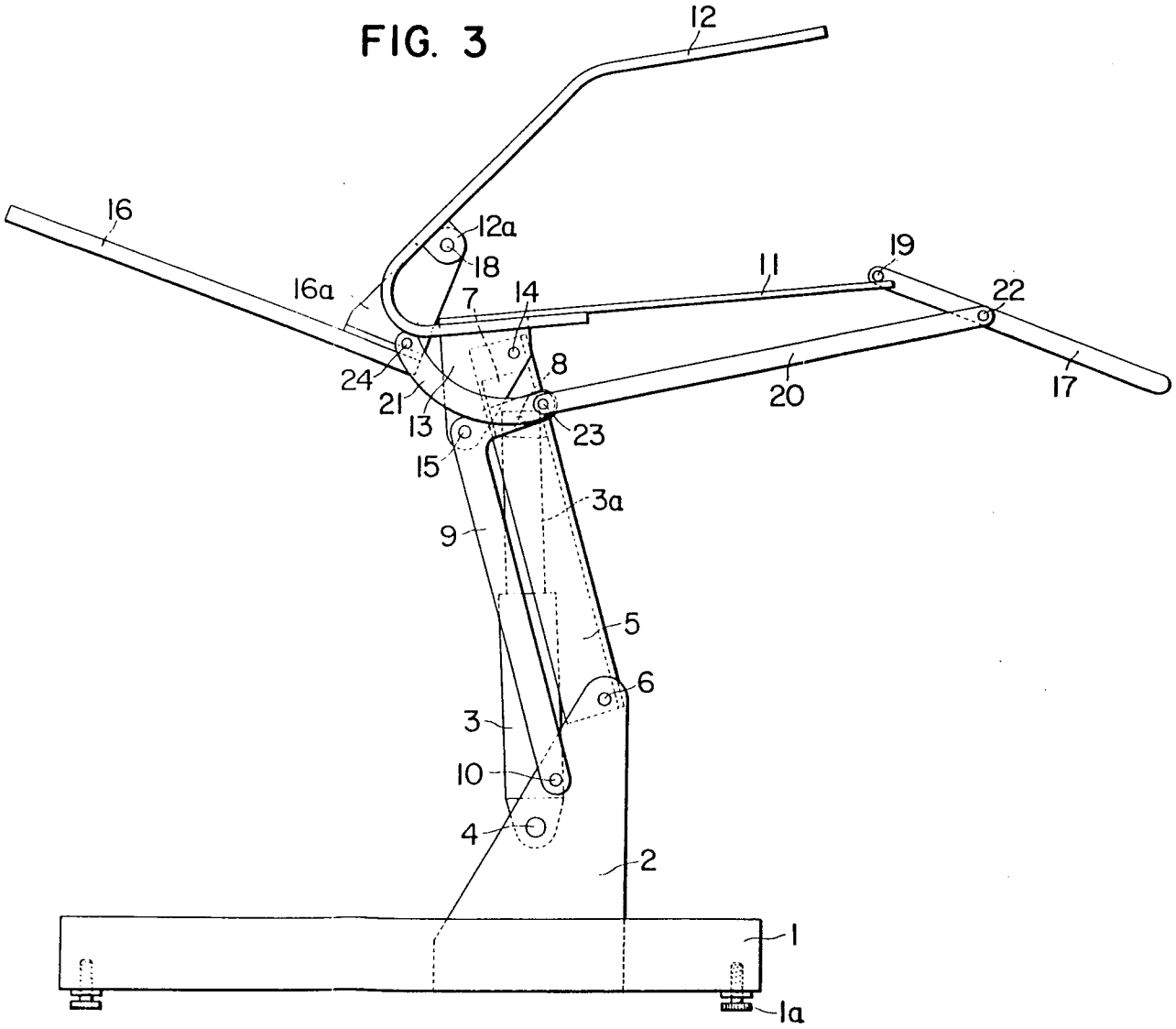
FIG. 3—Totally reclined, for back shampooing.

In service and usage of the chair, when the plunger **3*a* rises, the mainlink, as indicated in the FIG. 2, rises and the back reclines through #7. The seat plate #11, through the mechanism of the bracket #13 and #14, rises and slides forward as the FIG. 3 indicates. When this happens, the back plate, through #9*a* and #21, reaches the reclined stage indicated in the FIG. 3. (The sublink 9 rotates counterclockwise, using the pivot #10 as a fulcrum). At the same time, the footrest #17, through #20 and #22, lifts itself up as indicated in the FIG. 3. When the plunger 3*a*** returns to its original position, each part similarly returns to its original position. Depending on the height of the shampoo bowl, the adjuster #1*a* can be set.

It thus will be seen that there is provided a barber or beauty parlor chair for back shampooing of the head of a person which achieves the various objects of the invention, and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A beauty parlor or barber shop chair, said chair having pivoted frame members manipulatable by an integral hydraulic cylinder, so that the chair is adjustable from an upright position into a reclined and substantially horizontal position, whereby back-shampooing of the head of a person sitting in the chair may be accomplished with comfort, which comprises:

(a) a generally horizontal base member, (b) a substantially vertical supporting plate, said supporting plate being mounted to and extending upwards from said base member, (c) a hydraulic cylinder, said hydraulic cylinder having an upper plunger and being pivotally mounted to the middle region of said supporting plate, (d) a main link arm, one end of said main link arm being pivotally mounted to the upper end of said supporting plate, a middle region of said main link arm being pivotally mounted to the outer upper end of said plunger, (e) a rising bracket, said rising bracket being pivotally linked to the other end of said main link arm, (f) a sub link, said sub link being elbow-shaped, one end of said sub link being pivotally mounted to said supporting plate, the apex of said sub link being pivotally mounted to said rising bracket, (g) a foot rest plate, said foot rest plate being juxtaposed with said supporting plate, (h) a transverse connecting arm, said transverse connecting arm extending between a pivoted mounting at one end to said foot rest plate, and a pivoted mounting at the other end to the other end of said sub link, (i) a seat plate, said seat plate being adapted to receive the weight of the torso of said person and being disposed adjacent and above said transverse connecting arm, one end of said seat plate being pivotally mounted to the upper end of said foot rest plate, the other end of said seat plate being mounted to said rising bracket, (j) a curved connecting arm, one end of said curved connecting arm being pivotally mounted to both the other end of said sub link and the other end of said transverse connecting arm at a unitary pivoted linkage, (k) a back plate, said back plate being adapted to receive and support the back region of said person, (l) a connecting bracket, said connecting bracket extending laterally from the lower end of said back plate, the other end of said curved connecting arm being pivotally attached to said connecting bracket, and (m) an arm rest plate, said arm rest plate extending from a middle pivoted attachment to said connecting bracket, the other end of said arm rest plate being attached to said seat plate, so that, when said pivoted frame members are pivoted by activation of the upper plunger of said hydraulic cylinder, said foot rest plate is pivotally raised, said seat plate is raised, and said back plate is reclined, said chair being thereby adjusted from an upright position into a reclined and substantially horizontal position where the movements of the chair resemble the movements of a human body, whereby shampooing of the back of the head of a person sitting in said chair may be accomplished.

2. The chair of claim 1, in which said base member is provided with at least one adjustable mounting to a support floor or the like, so that the level or incline of said chair may be adjusted.

* * * * *